US010123385B1

(12) United States Patent
Chang

(10) Patent No.: US 10,123,385 B1
(45) Date of Patent: Nov. 6, 2018

(54) DIMMING CONTROLLER AND BACKLIGHT MODULE HAVING THE SAME

(71) Applicant: ANPEC ELECTRONICS CORPORATION, Hsinchu (TW)

(72) Inventor: Che-Chang Chang, Hsinchu County (TW)

(73) Assignee: ANPEC ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 15/857,957

(22) Filed: Dec. 29, 2017

(30) Foreign Application Priority Data

Sep. 1, 2017 (TW) ..... 106129987 A

(51) Int. Cl.
*H05B 33/08* (2006.01)
*H05B 37/02* (2006.01)
*G09G 3/34* (2006.01)

(52) U.S. Cl.
CPC ..... *H05B 33/0845* (2013.01); *G09G 3/3406* (2013.01); *H05B 37/0281* (2013.01); *G09G 2320/0247* (2013.01); *G09G 2320/064* (2013.01); *H05B 33/0809* (2013.01)

(58) Field of Classification Search
CPC ..... H05B 33/0845; H05B 37/0281; G09G 3/3406
See application file for complete search history.

(56) References Cited

U.S. PATENT DOCUMENTS 9,763,292 B2 * 9/2017 Kang ..... H05B 33/0815
2008/0238341 A1 * 10/2008 Korcharz ..... G09G 3/3413 315/297
2009/0021508 A1 * 1/2009 Ye ..... G09G 3/3406 345/212
2009/0160360 A1 * 6/2009 Lim ..... H05B 41/3925 315/294
2015/0076999 A1 * 3/2015 Malinin ..... H05B 33/0815 315/186
2015/0373798 A1 * 12/2015 Kim ..... H05B 33/0815 315/121
2016/0078821 A1 * 3/2016 Lee ..... G09G 3/3426 345/102
2016/0366737 A1 * 12/2016 Hong ..... H05B 33/0815
2018/0116016 A1 * 4/2018 Gamperl ..... H05B 33/0809

* cited by examiner

*Primary Examiner* — Dylan White
(74) *Attorney, Agent, or Firm* — Li & Cai Intellectual Property (USA) Office

(57) ABSTRACT

The present disclosure provides a dimming controller and a backlight module having the same, capable of distributing lighting times of each LED channel to a period of time. The dimming controller can decrease the duration of the LED string of each LED channel while maintaining under the duty cycle, thereby reducing the damage to the transistors. Besides, the dimming controller can turn on the transistors of the LED channels at different time points to avoid the higher current fluctuations at the output end, thereby reducing the flicker of the LED strings.

12 Claims, 10 Drawing Sheets

DIMMING CONTROLLER AND BACKLIGHT MODULE HAVING THE SAME

BACKGROUND

1. Technical Field

The present disclosure relates to a dimming controller and a backlight module having the same, in particular, to a dimming controller and a backlight module for decreasing the duration of lighting of each LED string.

2. Description of Related Art

Backlight module use LED channels with multiple LED strings to generate light. Backlight modules also have a controller controlling current flowing through the LED channels, thereby adjusting the lightness of each LED string. Reference is made to FIG. 1, which shows a conventional diagram of a backlight module. As shown in FIG. 1, the backlight module has an output-stage circuit 50, a dimming controller 60, and a plurality of LED channels LC1, LC2, and LC3. The output-stage circuit 50 is coupled to the LED channels LC1-LC3.

The output-stage circuit 50 has a power-stage circuit 52 and a power-stage controller 54. The power-stage controller 54 controls the switching of power transistors (not shown in FIGs) of the power-stage circuit 52, to convert an input voltage Vin into an output voltage Vout, thereby providing the output voltage Vout to the LED channels LC1-LC3. There are many types of output-stage circuits 50, for example, the buck converter, the boost converter, the inverter converter, the buck-boost converter, the flyback converter, and etc. The dimming controller 60 is coupled to the LED channels LC1-LC3. The dimming controller 60 generates a dimming control signal to the LED channels LC1-LC3 to control the switching of the transistors of the LED channels LC1-LC3, thereby adjusting the lightness of each LED string of the LED channels LC1-LC3.

The time of the dimming controller 60 lighting the LED string is determined by the duty cycle of a Pulse Width Modulation (PWM) signal. When the duty cycle of the PWM signal is 60%, the dimming controller 60 turns on the transistors for a 60% cycle time and turns off the transistors for a 40% cycle time, so that the LED string lights for the 60% cycle time. However, the transistors turned on for the 60% cycle time will overheat and damage the transistors. Therefore, if the time last for turning on the transistors can be reduced and the duty cycle can be maintained simultaneously, damage to the transistors can be reduced without effecting the duty cycle.

SUMMARY

Accordingly, an objective of the present disclosure is to provide a dimming controller and a backlight module having the same, which can distribute a lighting time of each LED channel to a period of time. The dimming controller can decrease duration of the LED string of each LED channel under maintaining the duty cycle, thereby reducing the damage of transistors. Besides, the dimming controller can turn on the transistors of the LED channels at different time points to avoid that the higher current fluctuations of the output end, thereby reducing the flicker of the LED strings.

An exemplary embodiment of the present disclosure provides a dimming controller. The dimming controller is adapted for a backlight module and is used for controlling a plurality of LED channels. The dimming controller includes a processor, a register, and a PFM generator. The processor periodically generates a vertical synchronization signal with a first time and a horizontal synchronization signal with a second time and generates a lightness adjustment signal within each first time. The vertical synchronization signal and the horizontal synchronization signal synchronize a screen. The first time is longer than the second time. The first time is divided into a plurality of time intervals. Each time interval is composed of the second times. The register is coupled to the processor. The register receives and temporarily stores the lightness adjustment signal. The lightness adjustment signal includes a lighting time of each LED channel. The PFM generator is coupled to the processor and the register. The PFM generator receives the vertical synchronization signal, the horizontal synchronization signal, and the lighting time of each LED channel, and respectively generates a PFM signal having the time intervals according to the lighting time of each LED channel. In each PFM signal, the PFM generator divides the corresponding lighting time by viewing the time interval as a divided unit to generate at least one lighting signal and the PFM generator distributes the at least one lighting signal to the different time intervals to control the corresponding LED channel according to the at least one lighting signal.

An exemplary embodiment of the present disclosure provides a backlight module. The backlight module includes a plurality of LED channels, an output-stage circuit, and a dimming controller. The output-stage circuit is coupled to the LED channels. The output-stage circuit converts an input voltage into an output voltage to provide the output voltage to the LED channels. The dimming controller is coupled to the LED channels and is used for controlling the LED channel. The dimming controller includes a processor, a register, and a PFM generator. The processor periodically generates a vertical synchronization signal with a first time and a horizontal synchronization signal with a second time and generates a lightness adjustment signal within each first time. The vertical synchronization signal and the horizontal synchronization signal synchronize a screen. The first time is longer than the second time. The first time is divided into a plurality of time intervals. Each time interval is composed of the second times. The register is coupled to the processor. The register receives and temporarily stores the lightness adjustment signal. The lightness adjustment signal includes a lighting time of each LED channel. The PFM generator is coupled to the processor and the register. The PFM generator receives the vertical synchronization signal, the horizontal synchronization signal, and the lighting time of each LED channel, and respectively generates a PFM signal having the time intervals according to the lighting time of each LED channel. In each PFM signal, the PFM generator divides the corresponding lighting time by viewing the time interval as a divided unit to generate at least one lighting signal and the PFM generator distributes the at least one lighting signal to the different time intervals to control the corresponding LED channel according to the at least one lighting signal.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
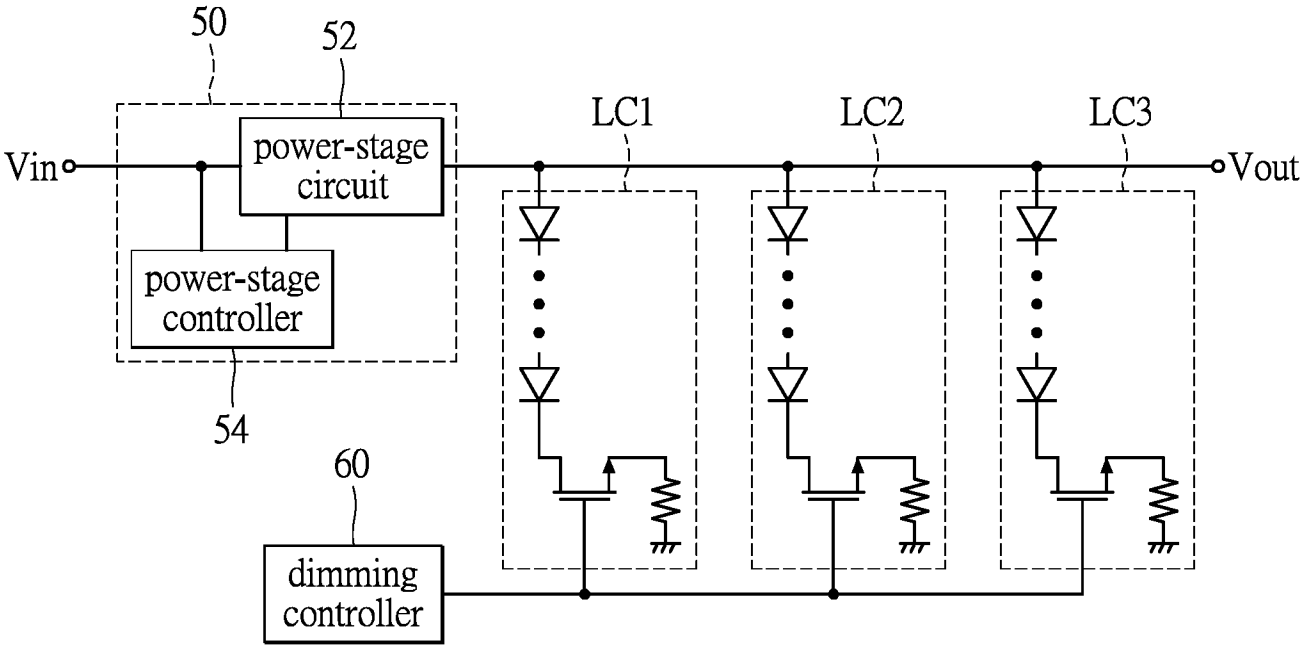
FIG. 1 PRIOR ART
FIG. 1 shows a conventional diagram of a backlight module.

Reference will now be made in detail to the exemplary embodiments of the present disclosure, examples of which are illustrated in the accompanying drawings. Wherever possible, the same reference numbers are used in the drawings and the description to refer to the same or like parts.

The present disclosure provides a dimming controller and a backlight module having the same. A processor is, for example, a TV scaler, periodically generating a vertical synchronization signal with a first time and a horizontal synchronization signal with a second time, and generating a lighting time controlling each LED channel. For the lighting time of each LED channel, the PFM generator of the dimming controller divides the lighting time into a plurality of lighting signals and distributes the lighting signals to different time intervals in the PFM signal, to control the corresponding LED channels according to the PFM signal. Accordingly, the dimming controller can decrease the duration of controlling the LED channels while maintaining the duty cycle, thereby reducing the damage to the transistors.

Besides, the PFM generator can further change the time intervals of the lighting signal distributing to the first time, so that the dimming generator can turn on the transistors of the LED channels at different time points to avoid the greater current fluctuations at the output end, thereby reducing the flicker of the LED strings of each LED channel. The dimming controller and the backlight module having the same provided in the exemplary embodiment of the present disclosure will be described in the following paragraphs.

Figure 2:
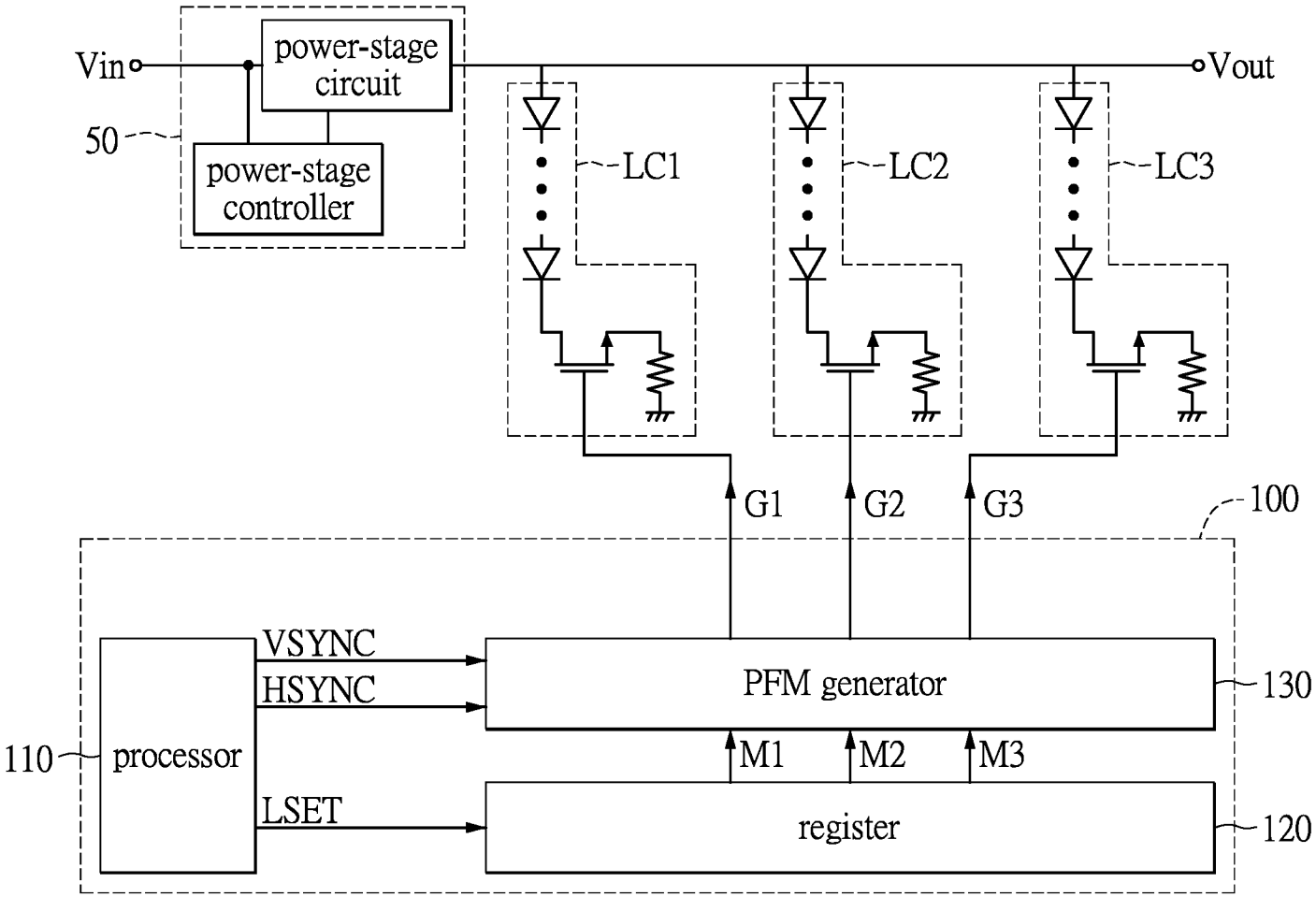
FIG. 2 shows a diagram of a backlight module according to an embodiment of the present disclosure.

Firstly, Reference is made to FIG. 2, which shows a diagram of a backlight module according to an embodiment of the present disclosure. As shown in FIG. 2, the backlight module has an output-stage circuit 50, a dimming controller 100, and a plurality of LED channels LC1, LC2, and LC3. The output-stage circuit 50 is coupled to the LED channels LC1-LC3. Internal components and operations of the output-stage circuit 50 and the LED channels LC1-LC3 are well known in the art, so that detailed descriptions are omitted. Therefore, the output-stage circuit 50 converts an input voltage Vin into an output voltage Vout to provide the output voltage Vout to the LED channels LC1-LC3.

Figure 4A:
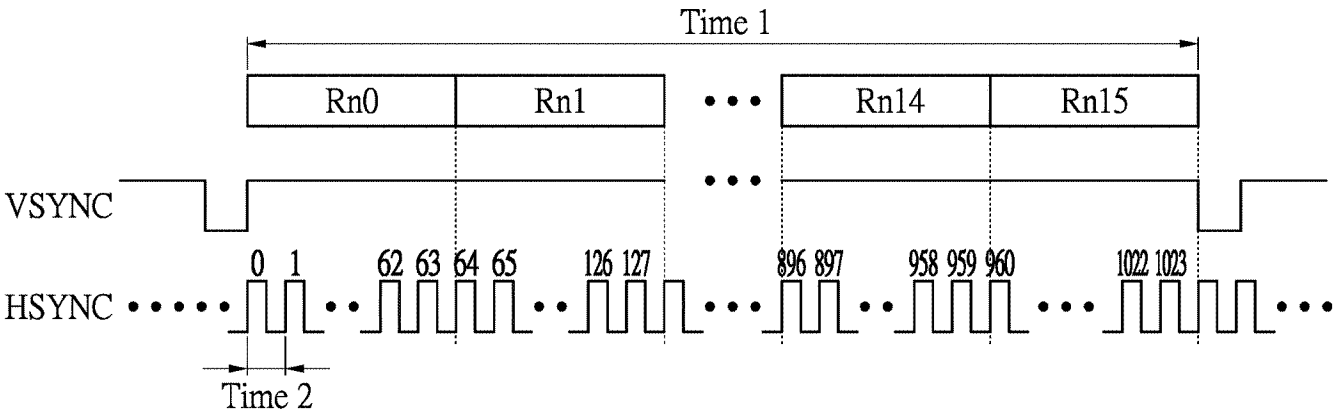
FIG. 4A shows a waveform diagram of a time interval and a second time according to an embodiment of the present disclosure.

The dimming controller 100 is used for controlling a current flowing through the LED channels LC1-LC3 to light up the LED strings of the LED channels. The dimming controller 100 includes a processor 110, a register 120, and a PFM (pulse frequency modulation) generator 130. Reference is made to FIGS. 2 and 4A, the processor 100 periodically generates a vertical synchronization signal VSYNC with a first time Time1 and a horizontal synchronization signal HSYNC with a second time Time2 to the PFM generator 130. In the present disclosure, the processor 110 is a TV scaler and which transmits the vertical synchronization signal VSYNC and the horizontal synchronization signal HSYNC used for synchronizing a screen to the PFM generator 130, so that the PFM generator 130 can synchronize the screen to control the LED channels LC1-LC3. Moreover, the implementation of the TV scaler generating the vertical synchronization signal VSYNC and the horizontal synchronization signal HSYNC to synchronize the screen are well known to those skilled in the art, and further descriptions are hereby omitted.

Figure 2A:
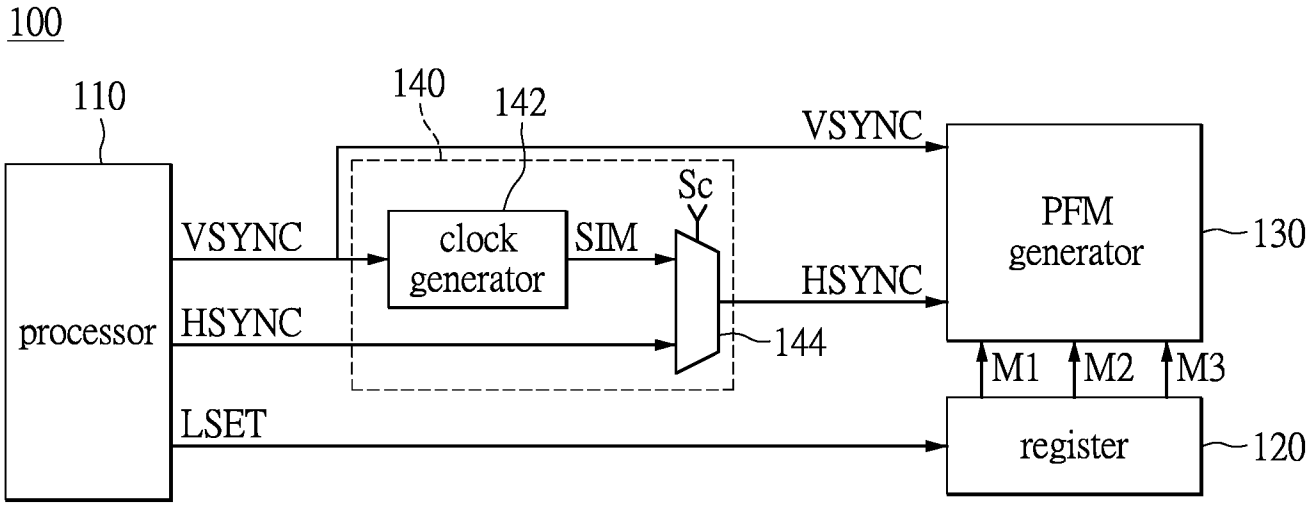
FIG. 2A shows a diagram of a dimming controller according to an embodiment of the present disclosure.

Reference is made to FIGS. 2 and 2A, in another disclosure, when the processor 110 cannot generate the horizontal synchronization signal HSYNC or generates an inaccurate horizontal synchronization signal HSYNC, the processor 110 can simulate the horizontal synchronization signal HSYNC by a synchronous signal generator for the PFM generator 130 to synchronize the screen to control the LED channels LC1-LC3. The dimming controller 100 further includes synchronous signal generator 140. The synchronous signal generator 140 includes a clock generator 142 and a selector 144. The clock generator 142 is coupled to the processor 110 and generates a simulation signal SIM indicating the horizontal synchronization signal HSYNC according to the vertical synchronization signal VSYNC. The selector 144 is coupled between the clock generator 142 and the PFM generator 130. The selector 144 receives the simulation signal SIM and the horizontal synchronization signal HSYNC, and then selects the simulation signal SIM or the horizontal synchronization signal HSYNC according to a selection signal Sc to be outputted to the PFM generator 130. In the present disclosure, the selection signal Sc is, but not limited to, generated by the processor 110, or can be generated by other external processors. Besides, the clock generator 142 of the present disclosure can be a phase lock-loop circuits (e.g., PLL, DPLL, or etc.) and the selector 144 can be a multiplexor. The present disclosure is not limited thereto.

Reference is made to FIG. 4A, the vertical synchronization signal VSYNC and the horizontal synchronization signal HSYNC are periodically generated. The frequency of the vertical synchronization signal VSYNC is lower than that of the horizontal synchronization signal HSYNC. In the present disclosure, the vertical synchronization signal VSYNC periodically generates a high-level signal with the first time Time1 and the horizontal synchronization signal HSYNC periodically generates a high-level signal with the second time Time2. For example, the frequencies of the vertical synchronization signal VSYNC are (60/120/240/480 Hz) and the frequencies of the horizontal synchronization signal HSYNC are (60/120/240/480 Hz)*1080 Hz, so that the first time Time1 is higher than the second time Time2. Therefore, during the first time Time1, the horizontal synchronization signal HSYNC will generate 1024 high-level signals, as shown in FIG. 4A the high-level signals from 0 to 1023.

More specifically, the processor 110 divides the first time Time1 into a plurality of time intervals Rn0, Rn1, Rn2, Rn3, Rn4, Rn5, Rn6, Rn7, Rn8, Rn9, Rn10, Rn11, Rn12, Rn13, Rn14 and Rn15. Each of the time intervals Rn0-Rn15 is composed of a plurality of the second times Time2. The processor 110 generates a lightness adjustment signal LSET within each first time Time1 and temporarily stores it in the register 120. Carrying on with the example above, each of the time intervals Rn0-Rn15 is composed of 64 second times Time2. For the sake of convenience, the following description is based on the example that there are 16 time intervals in the waveform diagram and each of the time intervals Rn0-Rn15 is composed of 64 second time Time2.

Referring back to FIG. 2, the register 120 is coupled to the processor 110. After the processor 110 generates the lightness adjustment signal LSET, the register 120 receives and temporarily stores the lightness adjustment signal LSET. The lightness adjustment signal LSET includes a lighting time M1 of the LED channel LC1, a lighting time M2 of the LED channel LC2, and a lighting time M3 of the LED channel LC3, for the PFM generator 130 to control the lightness of the LED string of each LED channel LC1-LC3 according to the lighting times M1-M3. In the present disclosure, the lighting times M1-M3 of the lightness adjustment signal LSET is expressed in hexadecimal. For example, the lighting time M1 is "084H," the lighting time M2 is "160H," and the lighting time M3 is "244H." The "000H" indicates the darkest light and the "FFFH" indicates the brightest light.

The PFM generator 130 is coupled to the processor 110 and the register 120. The PFM generator 130 receives the vertical synchronization signal VSYNC, the horizontal synchronization signal HSYNC, and the lighting times M1-M3 of the corresponding LED channels LC1-LC3. The PFM generator 130 respectively generates PFM signals G1, G2, and G3 with the time intervals Rn0-Rn15 according to the lighting times M1-M3 to respectively control the LED channels LC1-LC3.

Figure 4B:
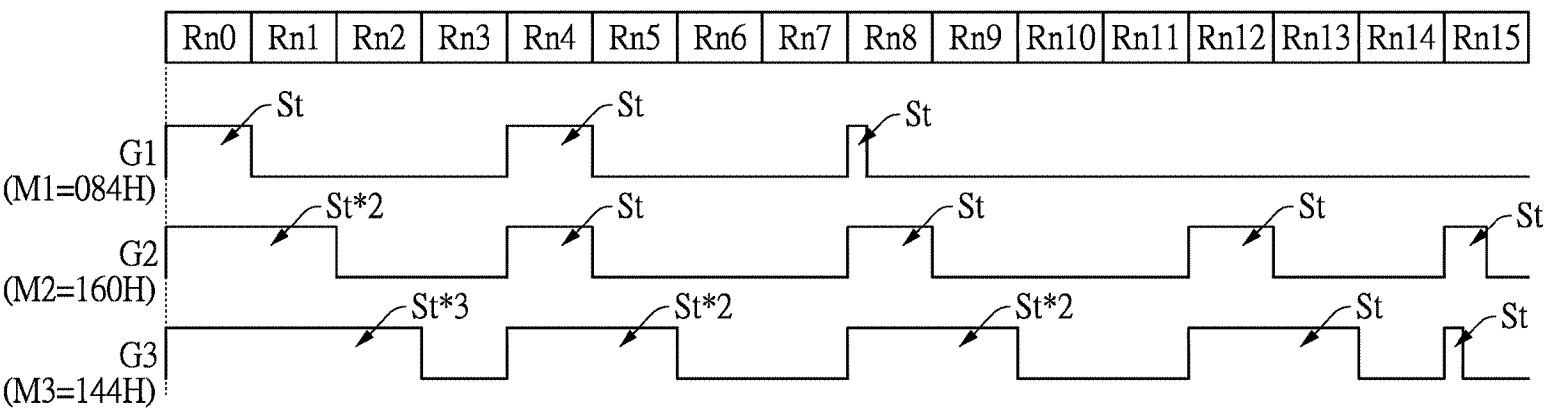
FIG. 4B shows a waveform diagram of the PFM signal in FIG. 3.

Reference is made to FIG. 4B, in each PFM signal G1-G3, the PFM generator 130 divides the corresponding lighting times M1-M3 by viewing the time interval as a divided unit to generate at least one lighting signal St. Then the PFM generator 130 distributes the at least one lighting signal St to the different time intervals Rn0-Rn15 of the corresponding PFM signals G1-G3. Taking the lighting time M2 to be "160H" as an example, the PFM generator 130 divides the corresponding lighting time M2 by viewing the time interval as a divided unit to generate 6 lighting signals St. Then the PFM generator 130 distributes 6 lighting signals St to the different time intervals Rn0, Rn1, Rn4, Rn8, Rn12 and Rn15 of the corresponding PFM signal G2.

More specifically, in each of the PFM signals G1-G3, the PFM generator 130 is cycled by the time intervals Rn0-Rn15 and configures the lighting signal St every predefined number of the time interval. When the time interval has configured the lighting signal St, the PFM generator 130 configures the lighting signal St in the next time interval. Besides, when there is a lighting signal St that does not meet the divided unit in at least one lighting signal St, the PFM generator 130 would configure the insufficient lighting signal St (i.e., the lighting signal St that does not meet the divided unit) behind the other lighting signals St that meet the divided unit (the lighting signals St that meet the divided unit is referred to sufficient lighting signal St).

Reference is made to FIG. 4B and the lighting time M2 to be "160H" is taken as an example, the PFM generator 130 sequentially configures six lighting signals St (i.e., 5 sufficient lighting signals St and 1 insufficient lighting signals St) to the different time intervals according to the aforementioned setup procedure. In the present disclosure, the predefined number is set to be 4. This means that the PFM generator 130 is cycled by the time intervals Rn0-Rn15 and configures the lighting signal St every 4 time intervals. Therefore, the PFM generator 130 sequentially configures five sufficient lighting signals St to the time intervals Rn0, Rn4, Rn8, Rn12, and Rn1. Next, the PFM generator 130 configures one insufficient lighting signal St to the time interval Rn15 (i.e., behind the 5 lighting signals St that meet the divided unit), thereby generating the PFM signal G2.

Figure 3:
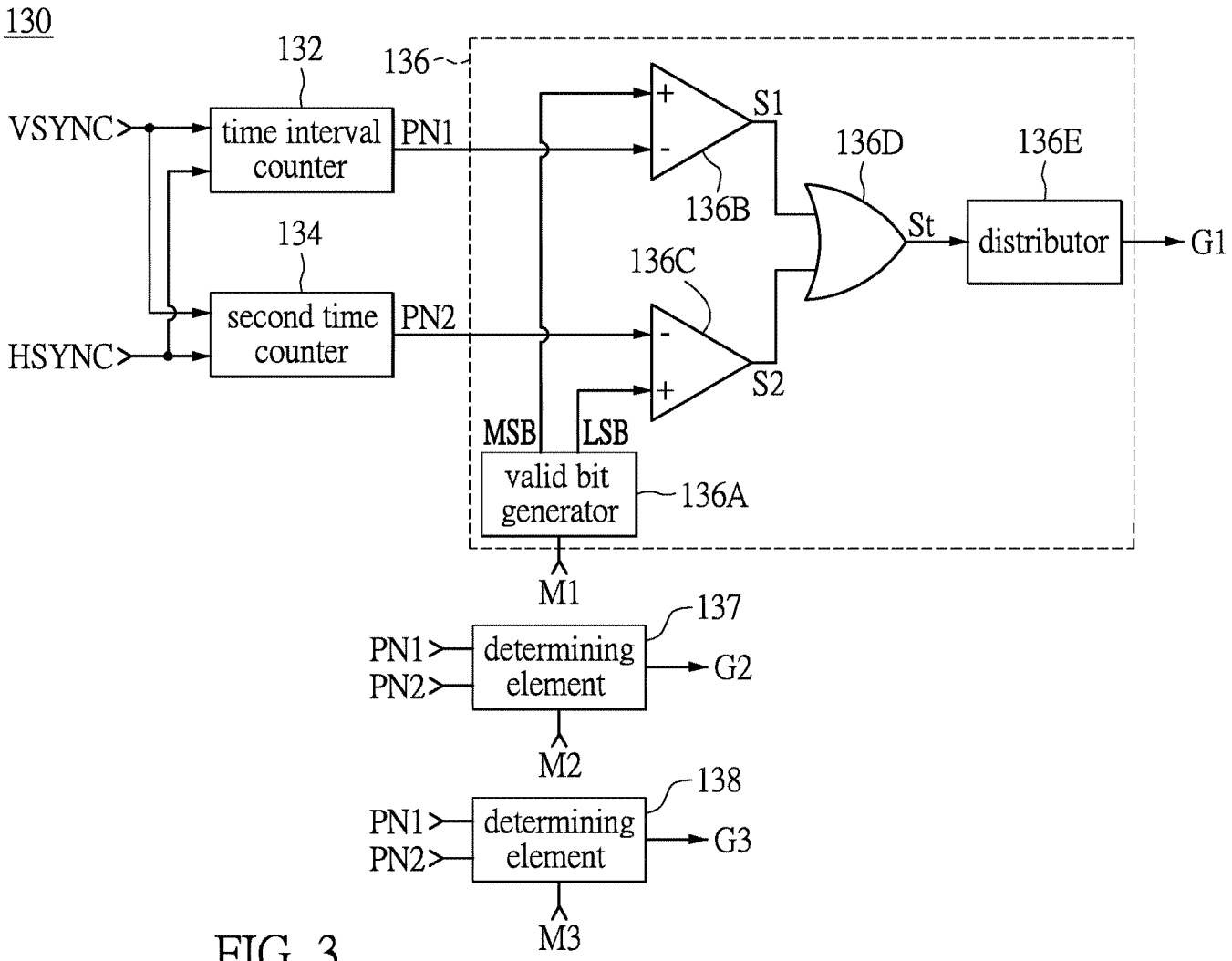
FIG. 3 shows a diagram of a PFM controller according to an embodiment of the present disclosure.

The actual architecture of the PFM generator 130 is described as follows. As shown in FIG. 3, the PFM generator 130 includes a time interval counter 132, a second time counter 134, and a plurality of determining elements 136, 137, and 138. The time interval counter 132 receives the horizontal synchronization signal HSYNC and the vertical synchronization signal VSYNC. The time interval counter 132 counts a present interval number PN1 of the time interval Rn0-Rn15 according to the horizontal synchronization signal HSYNC. When a reset signal (the low-level of the present disclosure) is generated in the vertical synchronization signal VSYNC, the time interval counter 132 resets the present interval number PN1. The second time counter 134 is coupled to the time interval counter 132 and receives the horizontal synchronization signal HSYNC and the vertical synchronization signal VSYNC. The second time counter 134 counts a present time number PN2 of the second time Time2 according to the horizontal synchronization signal HSYNC. When the reset signal (the low-level of the present disclosure) is generated in the vertical synchronization signal VSYNC, the second time counter 134 resets the present time number PN2.

The determining elements 136-138 are coupled to the time interval counters 132, the second time counter 134, and the register 120. Each of the determining elements 136-138 receives the present interval number PN1, the present time number PN2, and the corresponding lighting times M1-M3 to divide the corresponding lighting time M1-M3 according to the divided unit to generate the at least one lighting signal St. Each of the determining elements 136-138 then distributes the at least one lighting signal St to the different time intervals.

In the present disclosure, the internal circuits of the determining elements 136-138 are same, and the determining element 136 is described herein. The determining element 136 has a valid bit generator 136A, a first comparator 136B, a second comparator 136C, a logical element 136D, and a distributor 136E. The valid bit generator 136A receives the corresponding lighting time M1 and divides the corresponding lighting time M1 into a most significant byte MSB and a least significant byte LSB. Carrying on with the example above, the lighting time M1 is "084H" and the ten bits binary of the lighting time M1 indicates "0010000100." The most significant byte MSB is set to the first 4 bits, namely "0010." The least significant byte LSB is set to the last six bits, namely "000100." The valid bit generator 136A generates "2" in decimal to the first comparator 136B. The valid bit generator 136A generates "4" in decimal to the second comparator 136C. The most significant byte MSB and the least significant byte LSB may also be adjusted according to the actual situation. The present disclosure is not limited thereto.

The first comparator 136B is coupled to the time interval counter 132 and the valid bit generator 136A. The first comparator 136B compares the most significant byte MSB with the present interval number PN1 to generate a first signal S1. More specifically, the first comparator 136B has a positive input end, a negative input end, and an output end. In the first comparator 136B, the positive input end receives the most significant byte MSB and the negative input end receives the present interval number PN1. When the value of the most significant byte MSB is higher than or equal to the present interval number PN1, the output end generates the first signal S1 with the high-level. Conversely, when the value of the most significant byte MSB is lower than the present interval number PN1, the output end generates the first signal S1 with the low-level.

The second comparator 136C is coupled to the second time counter 134 and the valid bit generator 136A. The second comparator 136C compares the most significant byte MSB with the present time number PN2 to generate a second signal S2. More specifically, the second comparator 136C has a positive input end, a negative input end, and an output end. In the second comparator 136C, the positive input end receives the least significant byte LSB and the negative input end receives the present time number PN2. When the value of the least significant byte LSB is higher than or equal to the present time number PN2, the output end generates the second signal S2 with the high-level. Conversely, when the value of the least significant byte LSB is lower than the present time number PN2, the output end generates the second signal S2 with the low-level.

The logical element 136D is coupled to the first comparator 136B and the second comparator 136C and generates the at least one lighting signal St according to the first signal S1 and the second signal S2. Therefore, when the value of the most significant byte MSB is higher than or equal to the present interval number PN1 or the value of the least significant byte LSB is higher than or equal to the present time number PN2, the logical element 136D generates the lighting signal St (the high-level of the present disclosure). When the value of the most significant byte MSB is lower than the present interval number PN1 or the value of the least significant byte LSB is lower than the present time number PN2, the logical element 136D does not generate the lighting signal St (the low-level of the present disclosure).

Reference is made to FIGS. 3 and 4B. Continuing with the example above, the lighting time M1 is "084H." In the determining element 136, the first comparator 136B receives "2" in decimal and the second comparator 136C receives "4" in decimal. Therefore, the logical element 136D generates 2 sufficient lighting signals St and 1 insufficient lighting signal St (i.e., the time length is 4 second times Time2). In the present disclosure, the time length of one insufficient lighting signal St is related to at least one second time Time2, i.e., the time length is 4 second times Time2.

During the process of counting and zeroing the present interval number PN1 and the present time number PN2, the distributor 136E coupled to the logical element 136D receives the lighting signal St and distributes the lighting signals St to the different time intervals of the PFM signal G1, to correspondingly output the PFM signal G1. More specifically, the distributor 136E is cycled by the time intervals Rn0-Rn15 and configures the lighting signal St every predefined number of the time interval. When the time interval has configured the lighting signal St, the distributor 136E configures the lighting signal St in the next time interval. Besides, when there is the insufficient lighting signal St in at least one lighting signal St, the distributor 136E configures the insufficient lighting signal St behind the other sufficient lighting signals St.

Reference is made to FIGS. 3 and 4B, when the lighting time M1 is "084H," the logical element 136D generates 2 sufficient lighting signal St and 1 insufficient lighting signal St. In the present disclosure, the time interval of the predefined number is set to be 4, so that the distributor 136E is cycled by the time intervals Rn0-Rn15 and configures the lighting signal St every 4 time intervals. Therefore, the distributor 136E sequentially configures 2 sufficient lighting signals St to the time intervals Rn0 and Rn4. Next, the distributor 136E configures one insufficient lighting signal St to the time interval Rn8, thereby generating the PFM signal G1.

When the lighting time M2 is "160H" and the predefined number of the time interval is set to be 4, the determining element 137 receives the lighting time M2 and the ten bits binary of the lighting time M2 indicates "0101100000." The valid bit generator of the determining element 137 generates "5" in decimal to the first comparator of the determining element 137 and generates "32" in decimal to the second comparator of the determining element 137 (not shown in FIGs). Therefore, the logical element of the determining element 137 generates 5 sufficient lighting signal St and 1 insufficient lighting signal St (i.e., the time length is 32 second time Time2). At present, the time length of the insufficient lighting signal St is related to at least one second time Time2, i.e., the time length is 32 second time Time2. The distributor sequentially configures 5 sufficient lighting signals St to the time intervals Rn0, Rn4, Rn8, Rn12, and Rn1. Next, the distributor configures one insufficient lighting signal St to the time interval Rn15, thereby generating the PFM signal G2.

Reference is made to FIGS. 3 and 4B, when the lighting time M3 is "244H" and the predefined number of the time interval is set to be 4, the determining element 138 receives the lighting time M3 and the ten bits binary of the lighting time M3 indicates "1001000100." The valid bit generator of the determining element 138 generates "9" in decimal to the first comparator of the determining element 138 and generates "4" in decimal to the second comparator of the determining element 138 (not shown in FIGs). Therefore, the logical element of the determining element 138 generates 9 sufficient lighting signals St and 1 insufficient lighting signal St (i.e., the time length is 4 second time Time2). At present, the time length of the insufficient lighting signal St is related to at least one second time Time2, i.e., the time length is 4 second time Time2. The distributor sequentially configures 9 sufficient lighting signals St to the time intervals Rn0, Rn4, Rn8, Rn12, Rn1, Rn5, Rn9, Rn13, and Rn2. Next, the distributor configures one insufficient lighting signal St the time interval Rn15, thereby generating the PFM signal G3.

Therefore, the PFM generator 130 respectively divides the lighting times M1-M3 into a plurality of lighting signals St and distributes the lighting signals to the different time intervals of the corresponding PFM signals G1-G3 to control the corresponding LED channels LC1-LC3 according to the PFM signals G1-G3. Accordingly, the dimming controller 100 can decrease the duration of controlling the LED channels while maintaining the duty cycle, thereby reducing the damage to the transistors.

Figure 5:
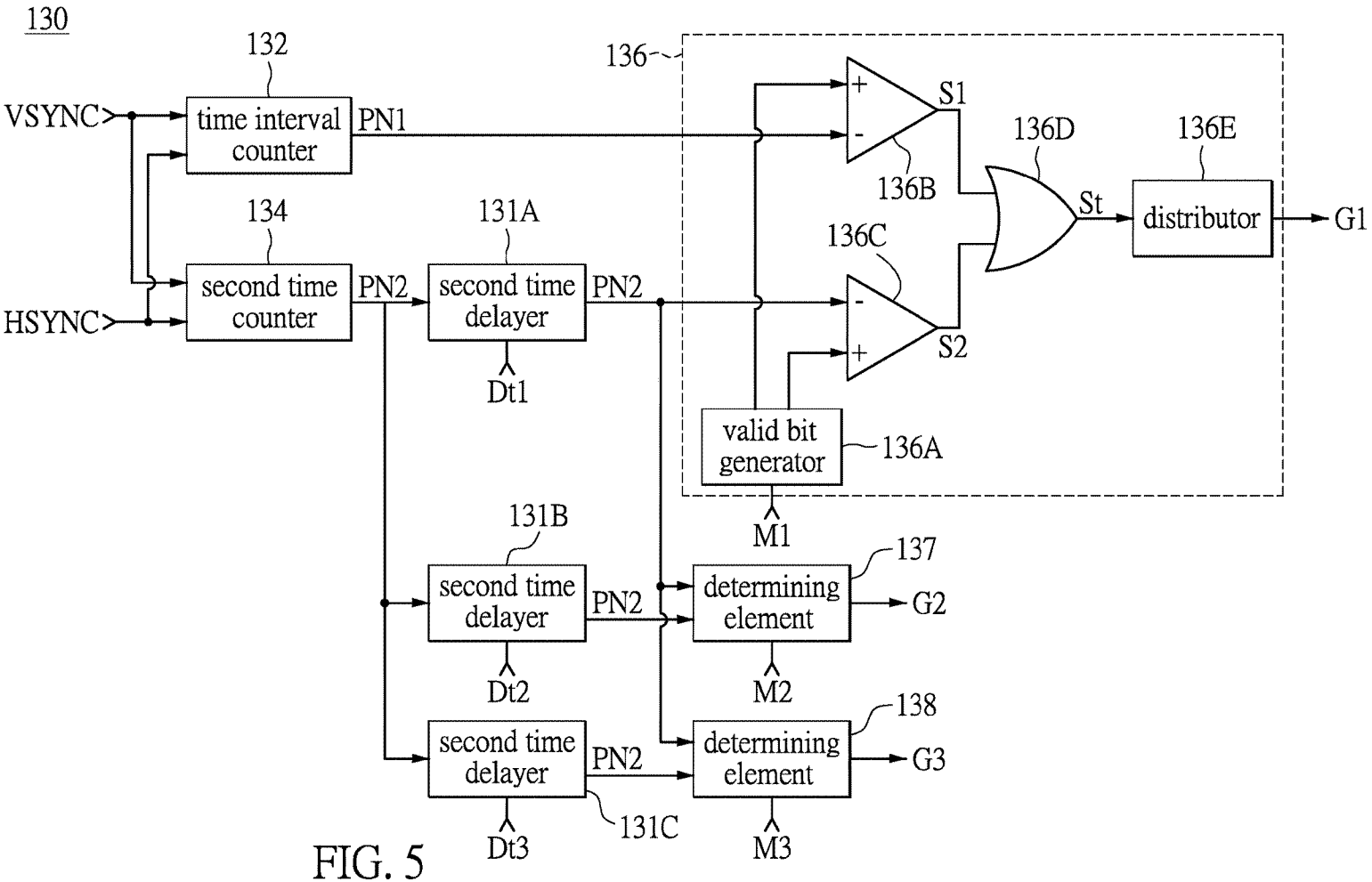
FIG. 5 shows a diagram of a PFM controller according to another embodiment of the present disclosure.

Reference is made to FIGS. 2 and 5, in another disclosure, the lightness adjustment signal LSET stored in the register 120 further includes a delay times Dt1, Dt2, and Dt3 of the corresponding LED channels LC1-LC3. The determining element 136 is coupled to the second time counter 134 through the second time delayer 131A. the second time delayer 131A receives the present time number PN2 and delays transmitting the present time number PN2 to the corresponding determining element 136 according to the corresponding delay time Dt1. The determining elements 137-138 is respectively coupled to the second time counter 134 through the second time delayers 131B-131C. The second time delayers 131B-131C receive the present time number PN2. The second time delayer 131B delays the transmission of the present time number PN2 to the corresponding determining element 137 according to the corresponding delay time Dt2. The second time delayer 131C delays the transmission of the present time number PN2 to the corresponding determining element 138 according to the corresponding delay time Dt3.

Figure 6:
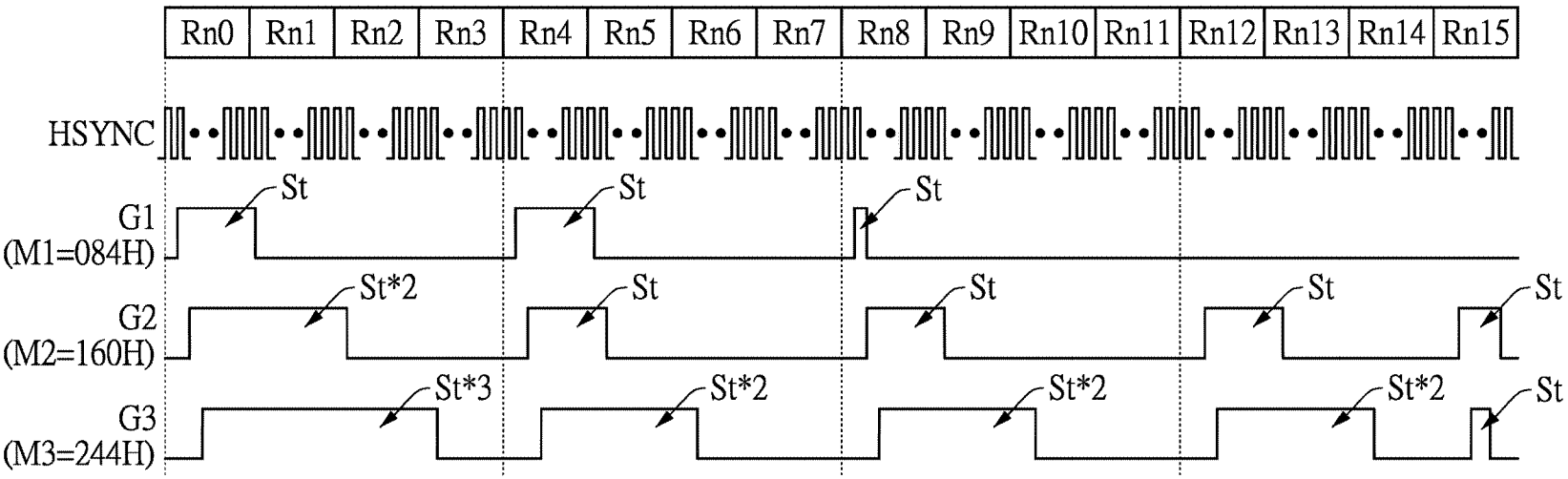
FIG. 6 shows a waveform diagram of the PFM signal in FIG. 5.

As shown in FIG. 6 and carrying on the PFM signals G1-G3 in FIG. 4B with the example above, when the delay times Dt1-Dt3 are respectively delayed by 1 second time Time2, 2 second times Time2, and 3 second times Time2, the determining elements 136-138 respectively generates the PFM signal G1 delaying 1 second time Time2, the PFM signal G2 delaying 2 second times Time2, and the PFM signal G3 delaying 3 second times Time2. The delay times Dt1-Dt3 may also be adjusted according to the actual situation. The present disclosure is not limited thereto.

In another disclosure, three determining elements 136-138 can be configured to the same second time delayer. More specifically, the lightness adjustment signal LSET stored in the register 120 further includes a delay time. The generator 130 has a second time delayer (not shown in FIGs). The second time delayer is coupled among the second time counter 134, the determining elements 136-138, and the register 120. The second time delayer receives the delay time and delays transmitting the present time number PN2 to the determining elements 136-138 according to the delay time (not shown in FIGs).

Accordingly, the determining elements 136-138 can delay the generation of the PFM signals G1-G3 according to the delay times Dt1-Dt3 and a delayed unit is a second time. Therefore, the PFM generator 130 can turn on the transistors of the LED channels at different time points to avoid higher current fluctuations at the output end, thereby reducing the flicker of the LED string of each LED channel.

Figure 7:
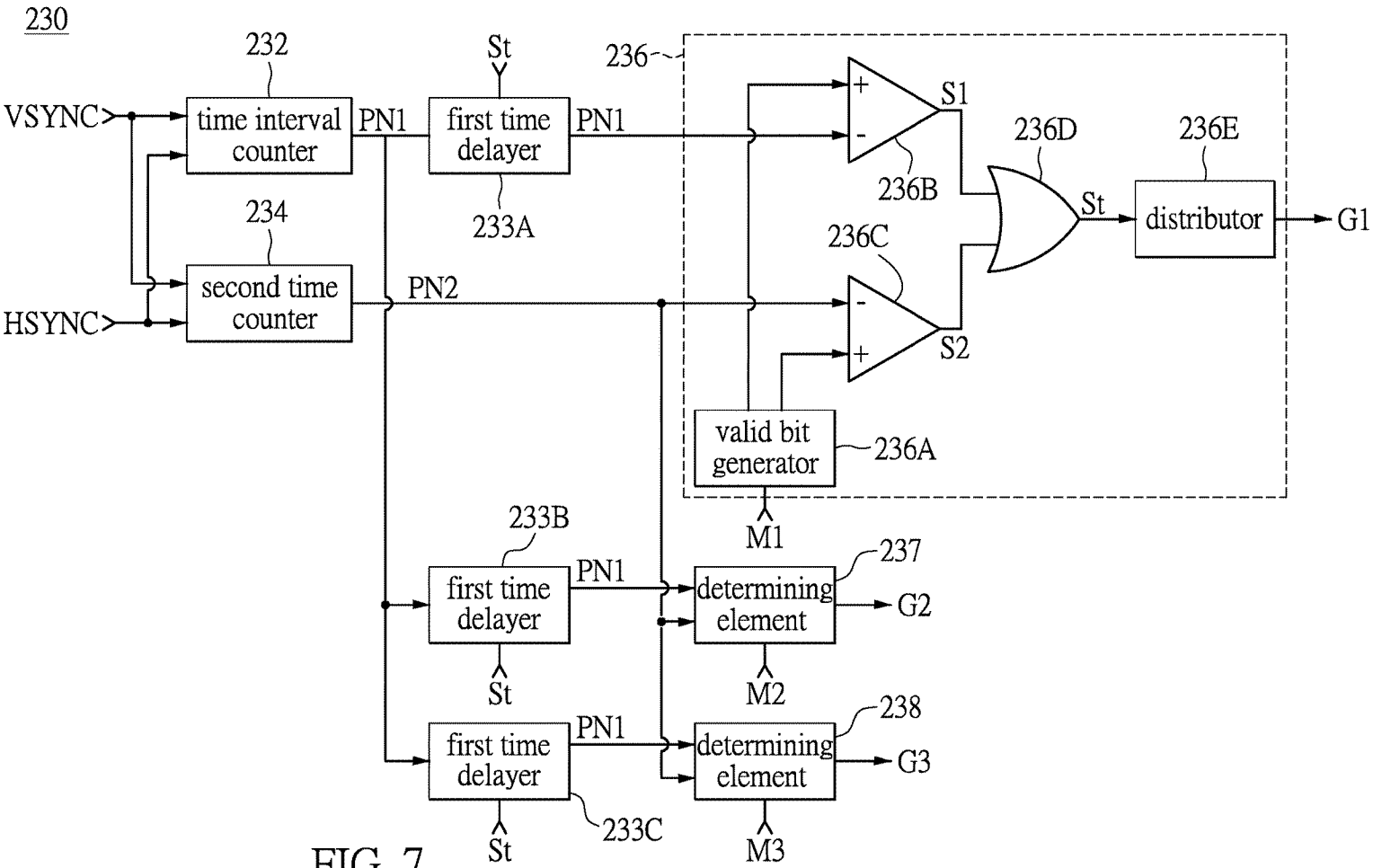
FIG. 7 shows a diagram of a PFM controller according to another embodiment of the present disclosure.

Reference is made to FIG. 7, which shows a diagram of a PFM controller according to another embodiment of the present disclosure. Comparing with the previous disclosure, the PFM generator 230 does not have the second time delayer and has the first time delayer. The determining element 236 is taken as the example for illustration. The determining element 236 is coupled to the time interval counter 234 through a first time delayer 233A. The first time delayer 233A receives at least one lighting signal St generated from the corresponding determining element 236. The first time delayer 233A delays transmitting the present interval number PN1 to the corresponding determining element 236 according to the number of the lighting signal St sufficient the divided unit.

Similarly, the determining elements 237-238 are respectively coupled to the time interval counter 234 through the first time delayers 233B and 233C. The first time delayer 233B receives at least one lighting signal St generated from the corresponding determining element 237 and the first time delayer 233C receives at least one lighting signal St generated from the corresponding determining element 238. The first time delayer 233B delays transmitting the present interval number PN1 to the corresponding determining element 237 according to the number of the sufficient lighting signal St. The first time delayer 233C delays transmitting the present interval number PN1 to the corresponding determining element 238 according to the number of the sufficient lighting signal St.

With respect to architecture and implementation of the time interval counter 232, the second time counter 234, and the determining elements 236-238 in the PFM generator 230 are the same as those of the time interval counter 132, the second time counter 134, and the determining elements 136-138 in the PFM generator 130, so that detailed descriptions thereof are omitted for the sake of brevity.

Figure 8A:
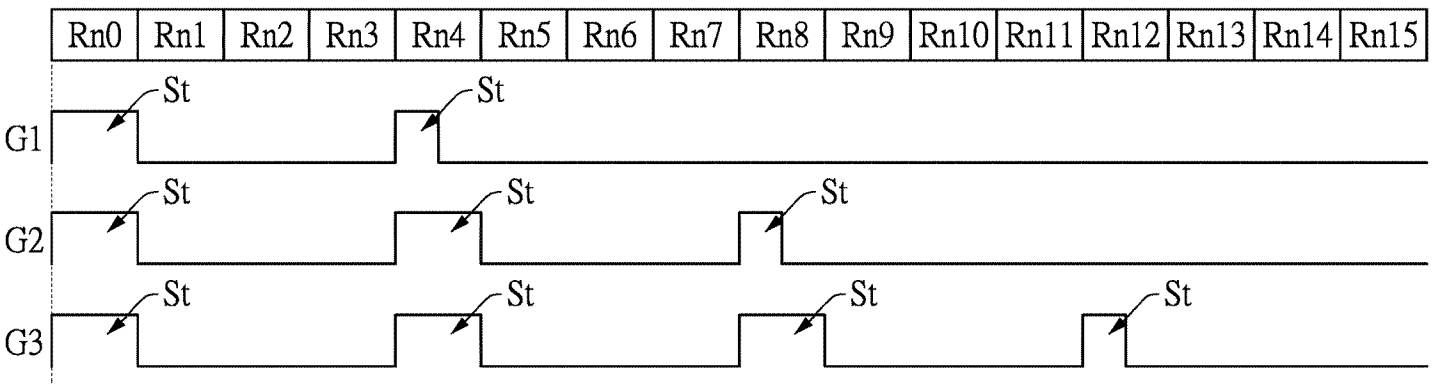
FIG. 8A shows a waveform diagram of the PFM signal in FIG. 7.

Reference is made to FIG. 8A, which shows a waveform diagram of a PFM signal in FIG. 7. The determining element 236 generates 1 sufficient lighting signal St, the determining element 237 generates 2 sufficient lighting signals St, and the determining element 238 generates 3 sufficient lighting signals St. The first time delayers 233A receives 1 lighting signal St generated from the corresponding determining element 236, the first time delayers 233B receives 2 lighting signals St generated from the corresponding determining element 237, and the first time delayers 233C receives 3 lighting signals St generated from the corresponding determining element 238.

Figure 8B:
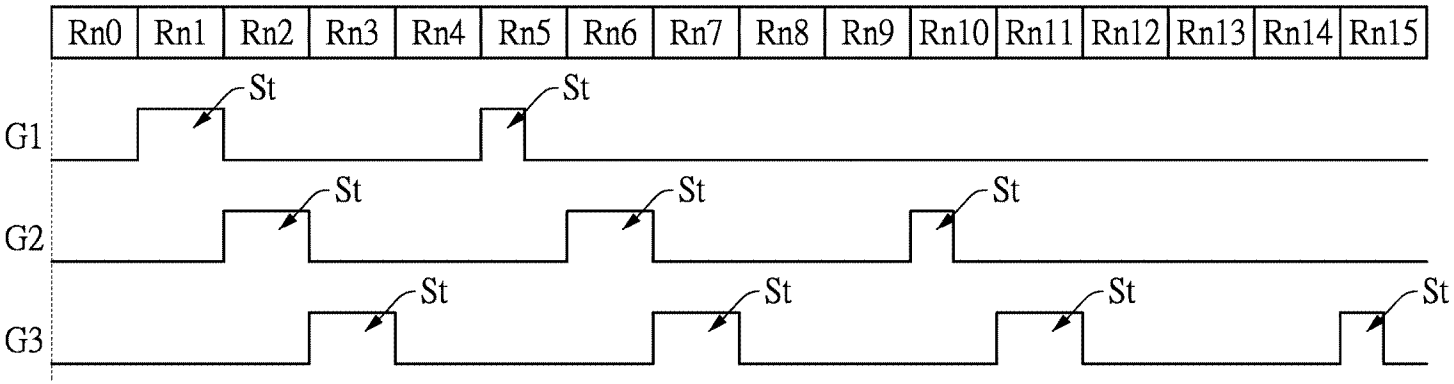
FIG. 8B shows another waveform diagram of the PFM signal in FIG. 7.

Next, as shown in FIG. 8B, the first time delayer 233A delays the transmission of the present interval number PN1 to the corresponding determining element 236 according to 1 sufficient lighting signal St, so that the determining element 236 generates the PFM signal G1 delaying 1 time interval. The first time delayer 233B delays the transmission of the present interval number PN1 to the corresponding determining element 237 according to 2 sufficient lighting signals St, so that the determining element 237 generates the PFM signal G2 delaying 2 time intervals. The first time delayer 233C delays the transmission of the present interval number PN1 to the corresponding determining element 238 according to 3 sufficient lighting signals St, so that the determining element 238 generates the PFM signal G3 delaying 3 time intervals.

Figure 8C:
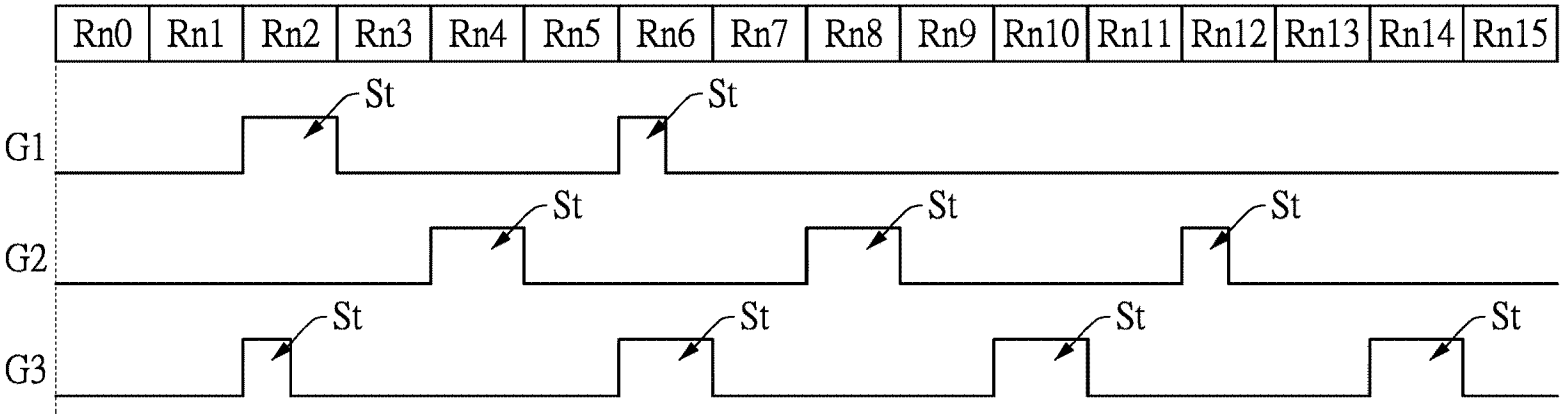
FIG. 8C shows another waveform diagram of the PFM signal in FIG. 7.

Next, as shown in FIG. 8C, when the determining elements 236-238 respectively generate 1, 2, and 3 sufficient lighting signals St again, the first time delayers 233A-233C respectively delay transmitting the present interval number PN1 to the corresponding determining elements 236-238 according to 1, 2, and 3 sufficient lighting signals St. Comparing with FIG. 8B, the determining element 236 generates the PFM signal G1 delaying 1 time interval again, the determining element 237 generates the PFM signal G2 delaying 2 time intervals again, and the determining element 238 generates the PFM signal G3 delaying 3 time intervals again.

Accordingly, the determining element 236-238 will delay the corresponding PFM signals G1-G3 according to the number of the sufficient lighting signals St and a delay unit is a time interval. Therefore, the PFM generator 130 can turn on the transistors of the LED channels at different time points to avoid higher current fluctuations at the output end, thereby reducing the flicker of the LED string of each LED channel.

In summary, the present disclosure provides the dimming controller and the backlight module having the same, which can distribute lighting times of each LED channel to a period of time. The dimming controller can decrease the duration of the LED string of each LED channel while maintaining the duty cycle, thereby reducing the damage to the transistors. Besides, the dimming controller can turn on the transistors of the LED channels at different time points to avoid higher current fluctuations at the output end, thereby reducing the flicker of the LED strings.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A dimming controller adapted for a backlight module, used for controlling a plurality of LED channels, and the dimming controller comprising:

a processor periodically generating a vertical synchronization signal with a first time and a horizontal synchronization signal with a second time, and generating a lightness adjustment signal within each first time, wherein the vertical synchronization signal and the horizontal synchronization signal synchronize a screen, the first time is longer than the second time, the first time is divided into a plurality of time intervals, and each time interval is composed of the second times;

a register coupled to the processor, receiving and temporarily storing the lightness adjustment signal, wherein the lightness adjustment signal includes a lighting time of each LED channel; and a pulse frequency modulator generator (PFM generator) coupled to the processor and the register, receiving the vertical synchronization signal, the horizontal synchronization signal, and the lighting time of each LED channel, and respectively generating a PFM signal having the time intervals according to the lighting time of each LED channel;

wherein in each PFM signal, the PFM generator divides the corresponding lighting time, by viewing the time interval as a divided unit, to generate at least one lighting signal, and the PFM generator distributes the at least one lighting signal to the different time intervals to control the corresponding LED channel according to the at least one lighting signal.

2. The dimming controller according to claim 1, wherein in each PFM signal, when there is the insufficient lighting signal in at least one lighting signal, the PFM generator configures the insufficient lighting signal behind the other sufficient lighting signals.

3. The dimming controller according to claim 1, wherein in each PFM signal, the PFM generator is cycled by the time intervals and configures the lighting signal every predefined number of the time interval, wherein when the time interval has configured the lighting signal, the PFM generator configures the lighting signal in the next time interval.

4. The dimming controller according to claim 1, wherein in each PFM signal, at least one lighting signal has the insufficient lighting signal and a time-length of the insufficient lighting signal is related to the second time.

5. The dimming controller according to claim 1, further comprising a synchronous signal generator, wherein the synchronous signal generator comprises:

a clock generator coupled to the processor and generating a simulation signal indicating the horizontal synchronization signal according to the vertical synchronization signal; and a selector coupled between the clock generator and the PFM generator, receiving the simulation signal and the horizontal synchronization signal, and outputting the simulation signal or the horizontal synchronization signal to the PFM generator according to a selector signal.

6. The dimming controller according to claim 1, wherein the PFM generator comprises:

a time interval counter configured for counting a present interval number of the time interval according to the horizontal synchronization signal, wherein when a reset signal is generated in the vertical synchronization signal, the time interval counter resets the present interval number;

a second-time counter coupled to the time interval counter, configured for counting a present time number of the second time according to the horizontal synchronization signal, wherein when the reset signal is generated in the vertical synchronization signal, the second-time counter resets the present time number; and a plurality of determining elements coupled to the time interval counter, the second-time counter and the register, wherein each determining element receives the present interval number, the present time number, and the corresponding lighting time to divide the corresponding lighting time according to the divided unit to generate the at least one lighting signal and each determining element distributes the at least one lighting signal to the different time intervals.

7. The dimming controller according to claim 6, wherein each determining element comprises:

a valid bit generator receiving the corresponding lighting time and configured for dividing the corresponding lighting time into a most significant byte and a least significant byte;

a first comparator coupled to the time interval counter and the valid bit generator and comparing the most significant byte with the present interval number to generate a first signal;

a second comparator coupled to the second-time counter and the valid bit generator and comparing the least significant byte with the present time number to generate a second signal;

a logical element coupled to the first comparator and the second comparator and generating the at least one lighting signal according to the first signal and the second signal; and a distributor coupled to the logical element, receiving the at least one lighting signal, and distributing the at least one lighting signal to the different time intervals.

8. The dimming controller according to claim 7, wherein when the value of the most significant byte is higher than or equal to the present interval number or the value of the least significant byte is higher than or equal to the present time number, the logical element generates the lighting signal; and when the value of the most significant byte is lower than the present interval number and the value of the least significant byte is lower than the present time number, the logical element does not generate the lighting signal.

9. The dimming controller according to claim 6, wherein the lightness adjustment signal further comprises a delay time of each LED channel, each determining element is coupled to the second-time counter through a second-time delayer, each second-time delayer receives the present time number and delays transmitting the present time number to the corresponding determining element according to the corresponding delay time.

10. The dimming controller according to claim 6, wherein the lightness adjustment signal further comprises a delay time of each LED channel, the PFM generator further comprises a second-time delayer, the second-time delayer is coupled among the second-time counter, the determining elements, and the register, and the PFM generator delays transmitting the present time number to the corresponding determining element according to the delay time.

11. The dimming controller according to claim 6, wherein each determining element is coupled to the time interval counter through a first-time delayer, each first-time delayer receives the at least one lighting signal generated from the corresponding determining element and delays transmitting the present interval number to the corresponding determining element according to the number of the sufficient lighting signal.

12. A backlight module, comprising:

a plurality of LED channels;

an output-stage circuit coupled to the LED channels, converting an input voltage into an output voltage to provide the output voltage to the LED channels; and a dimming controller coupled to the LED channels and used for controlling the LED channel, and the dimming controller including:

a processor periodically generating a vertical synchronization signal with a first time and a horizontal synchronization signal with a second time and generating a lightness adjustment signal within each first time, wherein the vertical synchronization signal and the horizontal synchronization signal synchronize a screen, the first time is longer than the second time, the first time is divided into a plurality of time intervals, and each time interval is composed of the second times;

a register coupled to the processor, receiving and temporarily storing the lightness adjustment signal, wherein the lightness adjustment signal includes a lighting time of each LED channel; and a PFM generator coupled to the processor and the register, receiving the vertical synchronization signal, the horizontal synchronization signal, and the lighting time of each LED channel, and respectively generating a PFM signal having the time intervals according to the lighting time of each LED channel;

wherein in each PFM signal, the PFM generator divides the corresponding lighting time by viewing the time interval as a divided unit to generate at least one lighting signal and the PFM generator distributes the at least one lighting signal to the different time intervals to control the corresponding LED channel according to the at least one lighting signal.

* * * * *